United States Patent [19]

Farrer et al.

[11] 3,951,508

[45] Apr. 20, 1976

[54] INTERNAL COMBUSTION ENGINE IGNITION DISTRIBUTOR CAP

[75] Inventors: Richard E. Farrer, Anderson; Glendon D. Starks, Pendleton, both of Ind.

[73] Assignee: General Motors Corporation, Detroit, Mich.

[22] Filed: July 12, 1974

[21] Appl. No.: 487,930

[52] U.S. Cl. ..... 339/214 R; 200/19 DC

[51] Int. Cl.[2] ..... H01R 13/50; H01H 19/00

[58] Field of Search..... 339/217 R, 223 S, 26, 339/214 R, 215 R; 200/19 WG, 19 DC, 19 M, 19 R; 123/146.5 A, 146.5 R

[56] References Cited

UNITED STATES PATENTS

| | | | |
|---|---|---|---|
| 1,388,628 | 8/1921 | Berdon | 200/19 R |
| 1,721,720 | 7/1929 | Thomas | 123/146.5 A |
| 3,001,035 | 9/1961 | Butts | 200/19 DC |
| 3,140,140 | 7/1964 | Kohler et al. | 339/276 T |
| 3,888,225 | 6/1975 | Boyer et al. | 123/146.5 A |

*Primary Examiner*—Joseph H. McGlynn
*Assistant Examiner*—James W. Davie
*Attorney, Agent, or Firm*—Richard G. Stahr

[57] ABSTRACT

An internal combustion engine ignition distributor cap is premolded into an integral unit of electrically non-conductive material having a top portion, a plurality of output terminal towers, each having an axial bore, extending outwardly from and circumferentially arranged about the outer surface of the top portion and a peripheral wall portion. An insert member of an electrically conductive material having an electrical contact surface on at least one end thereof is inserted into the axial bore of each of the prior molded output terminal towers with the end thereof having the electrical contact surface extending into the space within the cap as defined by the inner surfaces of the top and peripheral wall portions. An output terminal of an electrically conductive material is electrically connected to the end of each of the insert members opposite the end thereof located within the space within the cap.

1 Claim, 9 Drawing Figures

INTERNAL COMBUSTION ENGINE IGNITION DISTRIBUTOR CAP

This invention is directed to an internal combustion engine ignition distributor cap and, more specifically, to an ignition distributor cap which is premolded of an electrically nonconductive material and electrically conductive insert members are inserted into the axial bore of each premolded output terminal tower thereof.

In the prior art, the output conductive members of ignition distributor caps are molded into the cap during the molding operation and, after the molding operation, a machining operation is required to provide a flat electrical contact surface on that portion of each which is in arc gap relationship with the rotor tip. Therefore, it is necessary that provision be made for securing the output conductive members in place in the mold during the molding process. Furthermore, this method is cumbersome in mass production as each output conductive member must be manually placed in the mold. Additionally, the reject rate is high as the output conductive members may be unacceptably misaligned or deformed during the molding process. The provision of a distributor cap wherein the output conductive members may be later inserted into the axial bores of the output terminal towers of a prior molded distributor cap, therefore, is desirable.

It is, therefore, an object of this invention to provide an improved internal combustion engine ignition distributor cap. It is an additional object of this invention to provide an improved internal combustion engine ignition distributor cap wherein the output conductive members may be later inserted into the axial bores of the output terminal towers of a prior mold distributor cap.

It is an additional object of this invention to provide an improved internal combustion engine ignition distributor cap molded into an integral unit of an electrically nonconductive thermoplastic material including a top portion having a plurality of circumferentially arranged output terminal towers extending outwardly therefrom and a peripheral wall portion.

In accordance with this invention, an internal combustion engine ignition distributor cap is provided wherein elongated insert members of an electrically conductive material are inserted into the axial bores of the output terminal towers of a prior molded distributor cap molded of a nonconductive thermoplastic material into an integral top portion having a plurality of circumferentially arranged output terminal towers, each having an axial bore, extending outwardly therefrom and a peripheral wall portion.

For a better understanding of the present invention, together with additional objects, advantages and features thereof, reference is made to the following description and accompanying drawing in which.

Throughout the several FIGURES of the drawing, like elements have been assigned like characters of reference.

Figure 1:
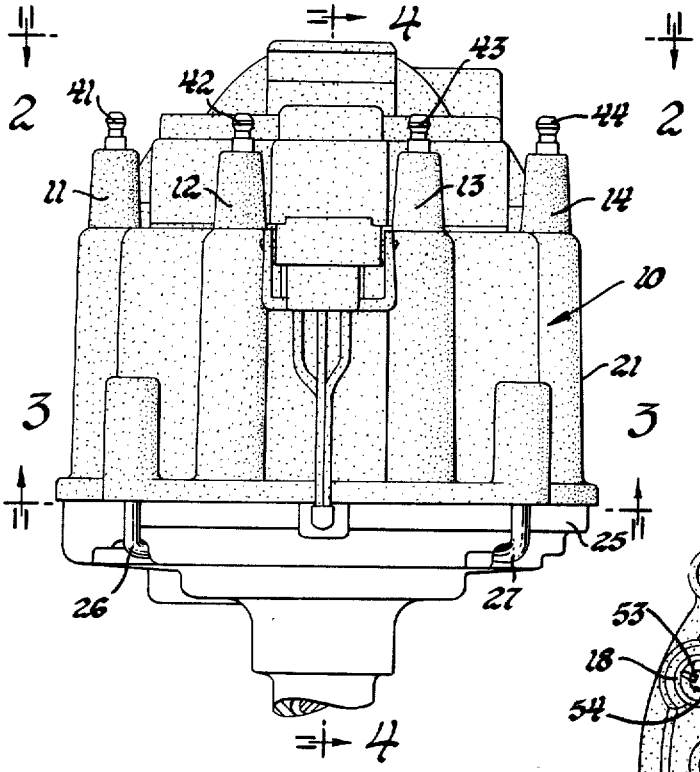
FIG. 1 is a side elevational view of the distributor cap of this invention mounted upon a conventional automotive type ignition distributor base.
Figure 4:
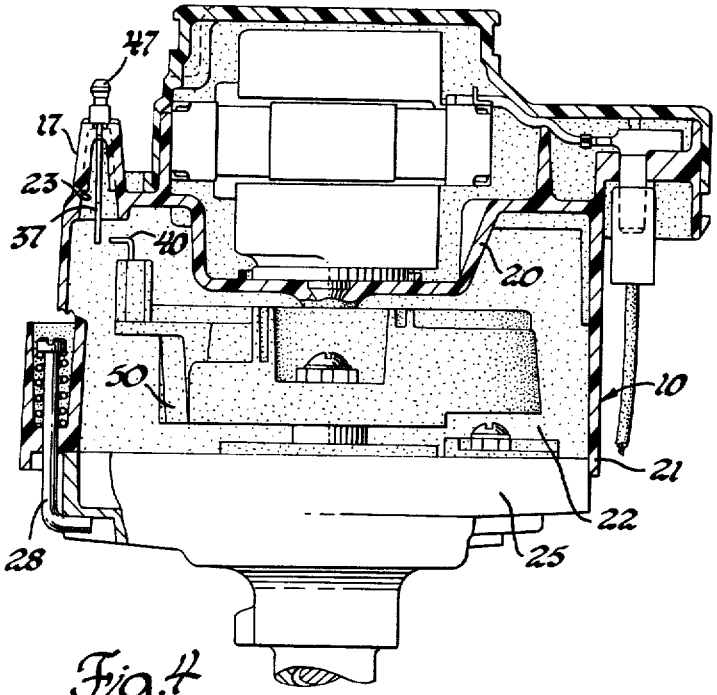
FIG. 4 is a section view of the ignition distributor cap of FIG. 1 taken along line 4—4 and looking in the direction of the arrows.
Figure 5:
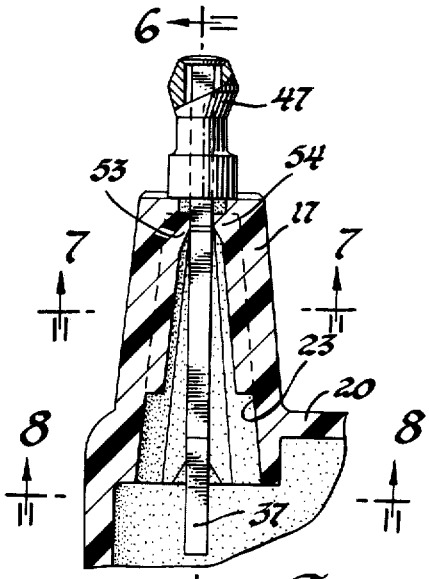
FIG. 5 is an enlarged cross-sectional view of an output terminal tower of FIG. 4.
Figure 6:
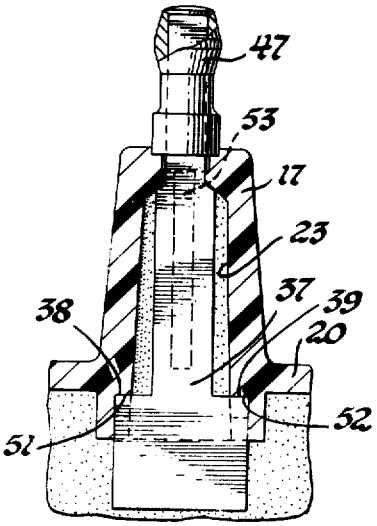
FIG. 6 is a sectional view of FIG. 5 taken along line 6—6 and looking in the direction of the arrows.
Figure 8:
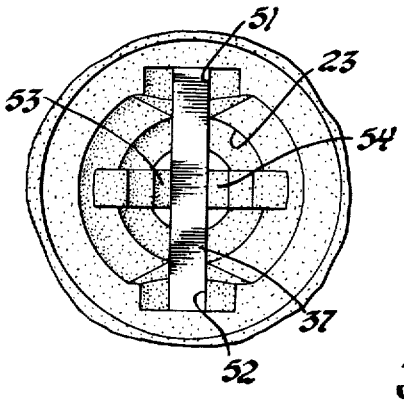
FIG. 8 is an enlarged bottom view of one of the output terminal towers looking in the direction of arrows 8—8.

The complete internal combustion engine ignition distributor cap 10 of this invention is best illustrated in FIGS. 1 and 4 and is comprised of a top portion 20, best seen in FIG. 4, a plurality of output terminal towers 11 through 18, each having an axial bore, extending outwardly from and circumferentially arranged about the outer surface of top portion 20 and a peripheral wall portion 21 molded into an integral unit of an electrically nonconductive material, the inner surfaces of top portion 20 and peripheral wall portion 21 defining a space 22 within cap 10. The axial bore extending through each of the output terminal towers is best seen in FIGS. 4, 5 and 6, which show sectional views of output terminal tower 17 which is typical of all of the output terminal towers and wherein the axial bore is referenced by the numeral 23.

Figure 2:
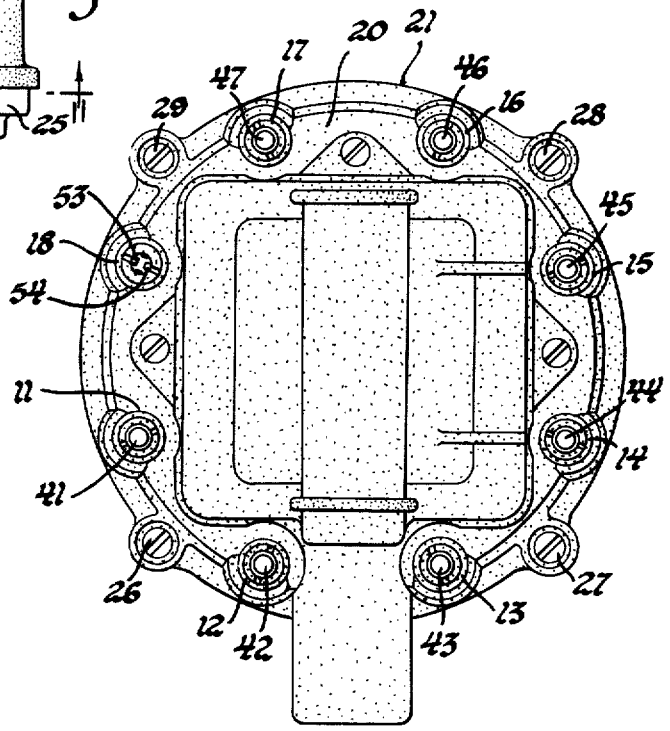
FIG. 2 is a top view of the distributor cap of FIG. 1 as looking in the direction of the arrows 2—2.

The ignition distributor cap of this invention may be secured to the bowl 25 of a conventional ignition distributor by four "L" bolts 26, 27, 28 and 29, as shown in FIGS. 1, 2 and 4.

The ignition distributor cap of this invention is preferably molded of a thermoplastic material. One example, and without intention or inference of a limitation thereto, of a commercially available thermoplastic polyester resin suitable for use as a nonconductive plastic material for the distributor cap of this invention is marketed by the General Electric Company and is identified by the registered trademark VALOX 420. This material is a 30% glass-reinforced resin containing glass fibers of a length of approximately ⅛ inch. It has been found that to mold an ignition distributor cap of a thermoplastic material is advantageous in that it is virtually impervious to moisture and does not scar or leave a low resistance path upon the surface thereof in the event of an electrical arc over within the distributor cap.

Figure 3:
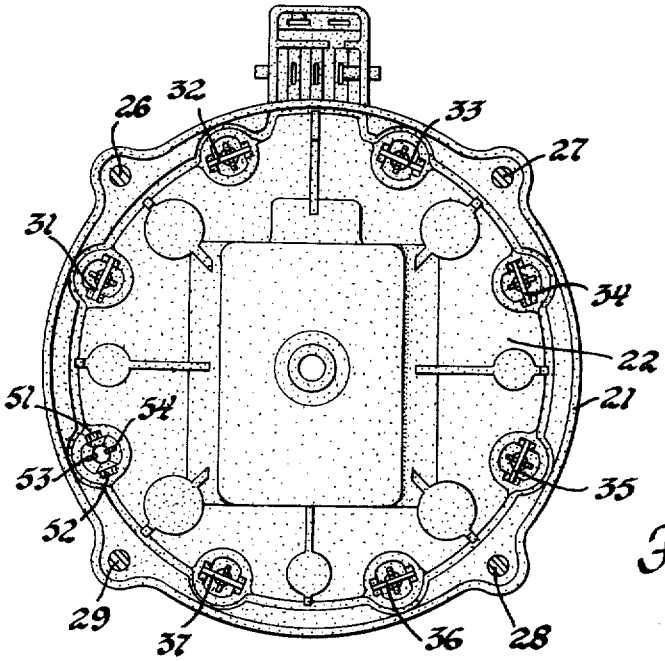
FIG. 3 is a bottom view of the distributor cap of FIG. 1 as looking in the direction of the arrows 3—3.
Figure 9:
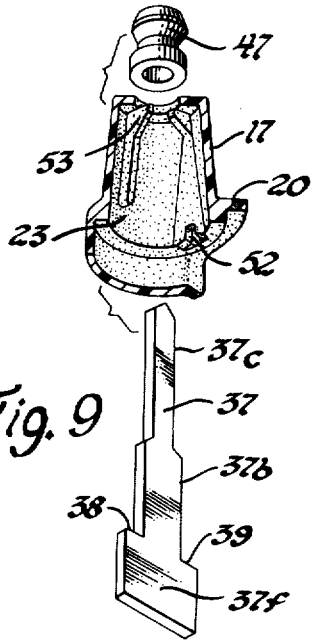
FIG. 9 is an exploded view of an insert member, one of the terminal towers into which it is inserted and an output terminal member.

An insert member of an electrically conductive material is inserted into the axial bore of each prior molded output terminal towers with one end thereof extending into the space 22 within the distributor cap. These insert members are best seen in the bottom view, FIG. 3, of cap 10 and are identified by the numerals 31, 32, 33, 34, 35, 36 and 37 and are illustrated as being inserted into position in the axial bore of respective output terminal towers 11, 12, 13, 14, 15, 16 and 17. In FIG. 3, there is no insert member shown to be inserted in the axial bore of output terminal tower 18 for the purpose of providing a view through the terminal tower axial bore. It is to be specifically understood that an insert member would be located within this axial bore with practical applications of the distributor cap of this invention. Preferably, each insert member is of an electrically conductive material such as copper or aluminum and has an electrical contact surface which extends into the space 22 within cap 10. The electrical contact surface of each insert member should be capable of accepting an electrical spark from the tip of the distributor rotor as it is passed in arc gap relationship therewith in a manner well known in the automotive art. One example, and without intention or inference of a limitation thereto, of an insert member suitable for use with the distributor cap of this invention is illustrated in FIG. 9. In FIG. 9, insert member 37 is illustrated as an elongated electrically conductive member of a rectangular cross-section having a flat face electrical surface 37*f* on one end thereof. Preferably, the insert member has a portion 37*b* of a reduced cross-sectional area and another portion 37*c* of a further reduced cross-sectional area and is of sufficient length to extend through the axial bore of the output terminal tower into which it is inserted and also through the bore of the corresponding output terminal member 47.

A positioning arrangement corresponding to each of the insert members is provided for locating the corresponding insert member within the output terminal tower axial bore into which it is inserted. In FIG. 3, the positioning arrangement is comprised of notches in an annular boss which surrounds the extremity of the axial bore in communication with the space 22 within the cap and a pair of raised guide members extending inwardly from the inner surface of the axial bore which are located diametrically opposite from each other and in a direction perpendicular to the direction of the slots. As the arrangement for positioning the insert member within the axial bore of the output terminal tower into which it is inserted is the same for all, in the interest of reducing drawing complexity the slots and guide members have been identified by reference numerals in regard to only one output terminal tower. As is best seen in FIG. 3, the two slots are referenced by the numerals 51 and 52 and the two guide members are referenced by the numerals 53 and 54. Slots 51 and 52 are arranged to accommodate the width and thickness of that end portion of the insert member of the greatest cross-sectional area and are so positioned that when the shoulders 38 and 39 of the insert member, FIG. 9, are in engagement with the bottom of the respective slots 51 and 52, the flat electrical contact surface 37*f* is substantially tangential to the imaginary circle centered about the center of the inner surface of top portion 20 and having a radius equal to the distance between the center and the point of tangency of the flat face surfaces of the insert members. Further, the depth of slots 51 and 52 are such that with shoulders 38 and 39 engaging the bottom thereof, the flat electrical contact surface 37*f* is in arc gap relationship with the conductive rotor tip carried by the distributor rotor. This is best illustrated in FIG. 4 where the conductive rotor tip is referenced by the numeral 40 and the distributor rotor is referenced by the numeral 50. This arrangement is well known in the automotive art.

Figure 7:
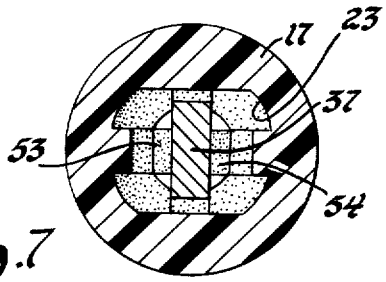
FIG. 7 is a section view of FIG. 5 taken along line 7—7 and looking in the direction of the arrows.

An output terminal of an electrically conductive material is electrically connected to the end of each insert member opposite the end thereof located within the space 22 within cap 10. Preferably, each output terminal is a male connector, as shown clearly in FIGS. 5, 6 and 9 and referenced by the numeral 47, having a center cylindrical bore of a type well known in the electrical art. The output terminal members are referenced by the numerals 41, 42, 43, 44, 45, 46 and 47 and are best seen in FIGS. 1, 2, 4, 5, 6 and 9. To provide a better view of the top of an output terminal tower, neither an insert member nor an output terminal is shown with output terminal tower 18 as has been previously brought out. Preferably, each insert member is of a sufficient length to pass through the axial bore of each output terminal tower and through the cylindrical bore of the output terminal as is best illustrated in FIGS. 6 and 7. With the pointed end of each insert member extending slightly beyond the furthest extremity of the output terminal cylindrical bore, this end portion may be mechanically rolled over into electrical engagement with the wall of the output terminal. With this arrangement, the insert members are maintained in position when the cap is placed in an upright position. It is to be specifically understood, however, that alternate methods of electrically connecting each output terminal to the corresponding insert member may be employed without departing from the spirit or the invention.

The ignition distributor cap of this invention has the following advantages over prior art distributor caps:

1. The cap molding time is substantially reduced as the output conductive elements are not preplaced in the mold to be molded into the cap during the molding operation.

2. The scrap loss during manufacture is reduced as during the molding process of manufacturing prior art distributor caps, one or more of the output conductive elements may be unacceptably misaligned or deformed.

3. Prior art caps having the output conductive elements molded therein require a final machining step which is completely eliminated by the distributor cap of this invention as the output conductive elements are inserted into the axial bore of the premolded output terminal towers and are maintained in the correct position by the aforementioned slots and guide elements.

While a preferred embodiment of the present invention has been shown and described, it will be obvious to those skilled in the art that various modifications and substitutions may be made without departing from the spirit of the invention which is to be limited only within the scope of the appended claim.

What is claimed is:

1. An internal combustion engine ignition distributor cap comprising: a top portion, a plurality of output terminal towers, each having an axial bore, extending outwardly from and circumferentially arranged about the outer surface of said top portion and a peripheral wall portion molded into an integral unit of an electrically nonconductive material, the inner surfaces of said top portion and said peripheral wall portion defining a space within said cap; an elongated unitary insert member of an electrically conductive material having a rectangular cross-section throughout the length thereof and a flat face surface on at least one end thereof inserted into said axial bore of each of said prior molded output terminal towers with the said end thereof having said flat face surface extending into said space within said cap and the opposite end extending beyond the top of said output terminal tower; positioning means corresponding to each of said insert members for locating the corresponding said insert member within the said output terminal tower axial bore into which it is inserted in such a manner that one of said flat face surfaces thereof extending into said space within said cap is substantially tangential to the imaginary circle centered about the center of the inner surface of said top portion and having a radius equal to the distance between said center and the point of tangency of said flat face surfaces of said insert members; and an output terminal of an electrically conductive material electrically connected to the end of each of said insert members opposite the end thereof located within said space within said cap.

* * * * *